United States Patent [19]

Yajima et al.

[11] 4,278,104

[45] Jul. 14, 1981

[54] SYSTEM FOR CONTROLLING THE NUMBER OF WASTE LIQUID DISPOSAL UNITS IN OPERATION

[75] Inventors: Hiroshi Yajima, Kawasaki; Norihisa Komoda, Yokohama; Susumu Horiuchi, Mito, all of Japan

[73] Assignee: Hitachi, Ltd., Tokyo, Japan

[21] Appl. No.: 937,854

[22] Filed: Aug. 29, 1978

[30] Foreign Application Priority Data

Sep. 9, 1977 [JP] Japan ..... 52-107813

[51] Int. Cl.[3] ..... G21F 9/08

[52] U.S. Cl. ..... 137/118; 23/230 A; 141/13; 141/192; 210/128; 252/301.1 W; 422/108; 422/159; 364/105; 364/106; 364/111; 364/112; 364/116; 364/504

[58] Field of Search ..... 252/301.1 W; 210/102, 210/142, 128; 23/230 A; 422/108, 159; 159/DIG. 12; 364/105, 106, 111, 112, 116, 504; 141/13, 192; 137/118

[56] References Cited

PUBLICATIONS

Morse, P. M., *Queues, Inventories and Maintenance*, John Wiley & Sons, Inc., 1958, New York, pp. 14–34.

*Primary Examiner*—Deborah L. Kyle

*Attorney, Agent, or Firm*—Craig and Antonelli

[57] ABSTRACT

A system for controlling the number of waste liquid disposal units in operation is disclosed in which the amount of waste liquid to be produced during a predetermined period of time is forecast, and the forecast result is used to calculate the required minimum number N of the waste liquid disposal units according to a predetermined formula, thereby to control the operation of the required minimum number N of the units among a plurality of waste liquid disposal units.

3 Claims, 8 Drawing Figures

SYSTEM FOR CONTROLLING THE NUMBER OF WASTE LIQUID DISPOSAL UNITS IN OPERATION

The present invention relates to a waste liquid disposal system for disposing of waste liquid in a plurality of waste liquid disposal units operated in parallel, or more in particular to a system for controlling the required minimum number of waste liquid disposal units without stand-by, no-load operation of the remaining units.

The description below will be made with reference to a radioactive waste liquid disposal system (hereinafter referred to as the R/W system) for an atomic power plant using a boiling-water type reactor for convenience'sake, although the present invention is not of course limited to such a system but applicable with equal effect to other waste liquid disposal systems.

Generally, an atomic power plant has a plurality of waste liquid disposal circuits as shown in FIG. 1A. The waste liquid produced from each power-generating unit such as 110 is transferred, depending on the type of waste liquid, to one of the plurality of circuits including a circuit 111*b* using a filter, a circuit 111*a* using a thickener and the like. Conventional BWR atomic power plants have an R/W system for each of the power-generating units. The circuit 111*a* of the R/W system is so constructed that radioactive waste liquid is temporarily stored in a storage tank 112 from which the waste liquid is supplied to a waste liquid disposal unit 114*a*. An example of configuration of the waste liquid disposal unit 114*a* is shown in FIG. 1C.

Reference numeral 1 shows a thickener, numeral 2 a steam condenser, numeral 3 a circulation pump, numeral 4 a waste liquid supply pump, numeral 5 a waste liquid valve, numeral 6 a valve for the thickened waste liquid, and numeral 7 an integrating flow meter, and numeral 100 a pre-heater. The radioactive waste liquid (hereinafter referred to as the waste liquid) supplied by the waste liquid supply pump 4 is sent through the waste liquid valve 5 and the pre-heater 100 to the thickener 1. The waste liquid is thickened by the thickener 1 by being forcibly circulated by the circulation pump 3. Steam generated in the thickener 1 is supplied to the steam condenser 2. When the integrating flow meter 7 detects that the waste liquid supplied to the thickener 1 has reached a predetermined amount, the waste liquid supply pump 4 is stopped, so that the waste liquid valve 5 is closed, while the thickened waste liquid valve 6 is opened thereby to deliver or bump (or dump) the thickened waste liquid from the thickener 1.

The waste liquid thus thickened is supplied to a granulator through a thin film drier and solidified with concrete or like.

According to a system now on the drawing board, the same kind of waste liquid produced in a plurality of power-generating units 110, 120 and 130 is collected in one storage tank 140 through pipes 111*a*, 121*a* and 131*a* and is thus subjected to centralized disposal as shown in FIG. 1B in order to rationalize the operation and lessen the size of the waste disposal system. FIG. 1B shows a schematic construction of a waste liquid disposal system to which the present invention is applicable. In this case, a greater amount of waste liquid than in the conventional system is naturally required to be disposed by each disposal circuit, so that a plurality of thickeners 151*a* to 151*d* are used. The reason why a plurality of thickeners instead of a single thickener is used will be described below. The thickner has been improved in various respects and is high in reliability, and it is difficult to scale it up further. Further, waste liquid is produced intermittently and in a distribution of high variance in many cases. In general, a waste liquid is intermittently produced, so that in the case of a large-sized thickener, waste liquid tank is often emptied before dumping, thereby necessitating the stand-by, no-load operation, thus leading to the lack of versatility and low economy. Stated another way, the storage tank sometimes becomes emptied before a predetermined waste liquid has been disposed. In this case, the thickening operation of the thickener must be interrupted and the stand-by operation must be conducted until some amount of waste liquid is stored in the storage tank, and then the interrupted thickener again must be operated, thereby leading to low versatility and low economy. Especially, the stand-by, no-load operation causes corrosion or scaling of the thickener. For these reasons, the tendency at present is to use a plurality of thickeners in each circuit. The problem is how many of the installed thickeners are to be operated at a given time point. Generally, a storage tank is installed in the stage prior to the thickeners for supplying waste liquid to the thickeners. If only a small number of thickeners are used for disposal for the reason that a small amount of waste liquid is stored in the tank, the waste liquid, if produced in great amount, may overflow the storage tank. If too many thickeners are operated in an attempt to reduce the possibility of such a phenomenon, on the other hand, waste liquid is emptied prior to the bumping from the thickeners, with the result that as explained above, the stand-by, no-load operation is undesirably necessitated or the bumping occurs before the concentration of the solid components of the waste liquid in the thickeners reaches a predetermined level required for normal bumping. If bumping occurs before the predetermined concentration level is reached, extraneous water is required to be removed in post-process. This of course increases the cost of the system. In view of the fact that the stand-by, no-load operation is as costly as normal operation, it is often more economical to bump even before the predetermined concentration is reached. From the foregoing explanation, it will be apparent that if too many thickeners are operated in an attempt to reduce the possibility of the waste liquid overflow phenomenon, the waste liquid is emptied before a predetermined waste liquid has been disposed, so that the thickening operation of the thickener must be interrupted and the stand-by operation must be conducted until some amount of the waste liquid is stored in the storage tank. In this case, corrosion or scaling of the thickener may be caused by such stand-by operation.

In order to avoid this problem, the liquid is bumped before the thickener disposes a predetermined amount of waste liquid, that is, before the concentration of the solid components of the waste liquid in the thickeners reaches a predetermined level required for normal bumping. In this case, extraneous water in the waste liquid must be removed in post-processing. Therefore, the waste liquid sufficiently thickened is usually not bumped merely in order to avoid the above stand-by operation.

The primary object of the present invention is to provide, in a waste liquid disposal system having a plurality of disposal units, a control system for using and operating the minimum required number of waste liquid disposal units according to the condition of the plant, thus eliminating any case of stand-by, no-load operation.

In order to achieve the above-mentioned object, according to the present invention, the amount of waste liquid to be produced is forecast over, say, N hours, and the forecast amount is used to calculate the maximum value m satisfying the following inequalities (1) and (2), thus newly starting additional m disposal units.

$$U_1 + U_2(I) \geqq V(I) + mV'(I) \quad (1)$$

$$U_1 + U_2(N) \geqq V(N) + mV' \quad (2)$$

where $U_1$: Amount of waste liquid stored in the storage tank at present $U_2(I)$: Amount of waste liquid forecast to be produced before I hours later. I is a given time satisfying the relation $0 < I \leqq N$ V(I): Amount of waste liquid expected to be disposed by P waste liquid disposal units in operation before I hours later (In the case where the waste in a particular waste liquid disposal unit is bumped before I hours later, however, that disposal unit is not assumed to be used after the bumping.)

V'(I): Amount of waste liquid disposed by each disposal unit for I hours m: A given integer V(N): Amount of waste liquid capable of being disposed of for N hours by the P waste liquid disposal units now in operation. (In the case where the waste liquid in a particular waste liquid disposal unit is bumped before N hours later, however, the particular disposal unit is not used after the bumping.)

V': Amount of waste liquid capable of being disposed of by each disposal unit before bumpig N: A predetermined value representing a maximum time point to be forecast from the present time.

The satisfaction of inequality (1) above means the following: In view of the fact that at any time I satisfying the relation $0 < I \leqq N$, the amount of waste liquid produced is always greater than that disposed of by the waste liquid disposal units, waste liquid is not depleted during operation of the thickeners. In other words, the stand-by, no-load operation of the thickeners is prevented for the period of time from the present time to N hours.

The fact that inequality (2) is met, on the other hand, means that at the time N hours later, the amount of waste liquid to be processed before bumping by the thickeners operated at that time is secured in the storage tank, thus eliminating any stand-by, no-load operation.

Further, selection of the maximum value m satisfying both inequalities (1) and (2) means that the stand-by, no-load operation of the disposal units is prevented on the one hand and the amount of waste liquid in the storage is kept minimized to provide a margin for storing an additional great amount of waste liquid which may be produced.

The above-mentioned system according to the present invention facilitates the operation of the waste liquid disposal units, reduces the operating cost of the thickeners, and further prevents the corrosion or scaling of the thickeners.

Generally, it requires 6 to 12 hours for a "bumped" thickener to restart for operation. If too many thickeners are operated, the bumping may occur at a number of the thickeners, making effective use of the thickeners impossible, in the event that a great amount of waste liquid is produced at the same time and is required to be disposed of quickly. According to the present invention, such an inconvenience is easily overcome by the fact that the required minimum number of thickeners are operated. Also, the frequency of bumping may be reduced in the process of disposal.

The above and other objects, features and advantages of the present invention will be made more clear from the following description with reference to the accompanying drawings, in which.

An embodiment of the present invention will be described below in detail.

Figure 1A:
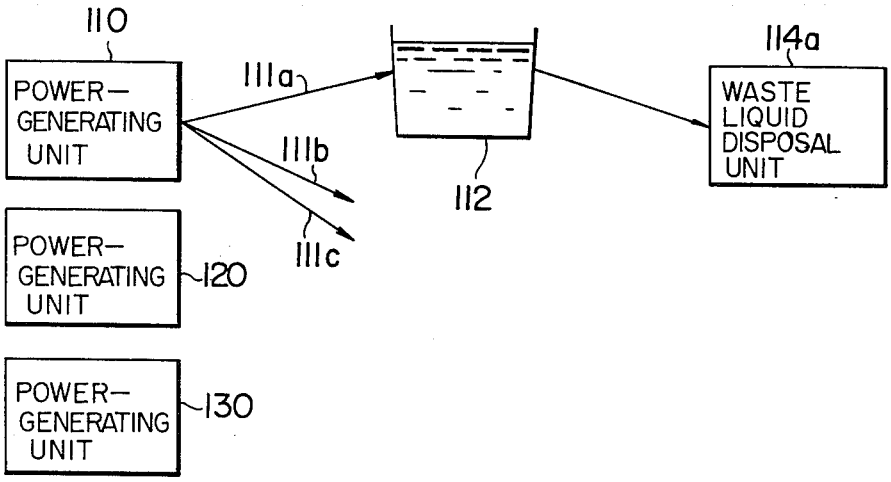
FIG. 1A PRIOR ART
FIGS. 1A, 1B and 1C are schematic diagrams for explaining the concept of a waste liquid disposal system.
Figure 1B:
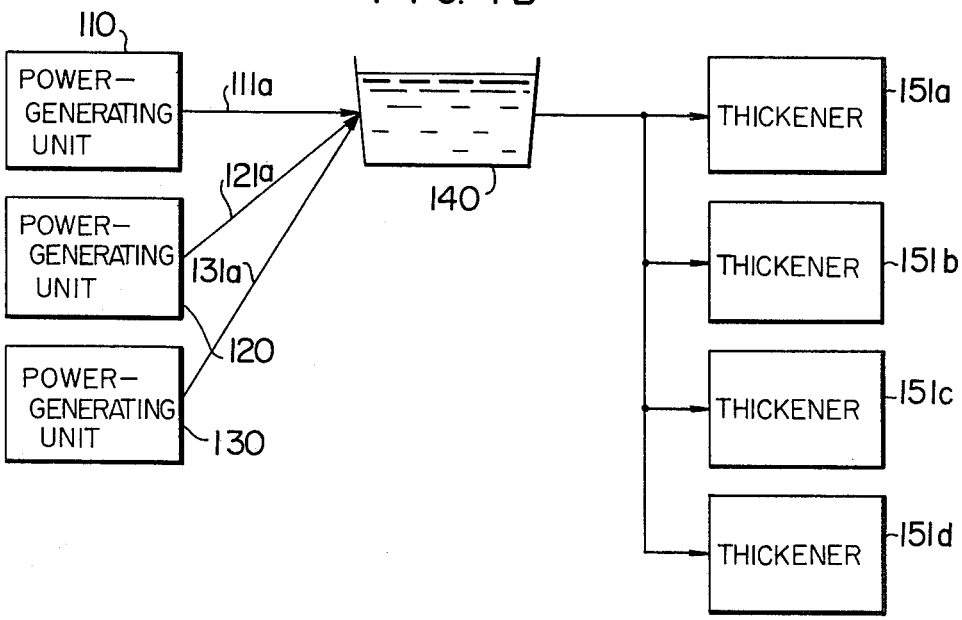
Figure 1C:
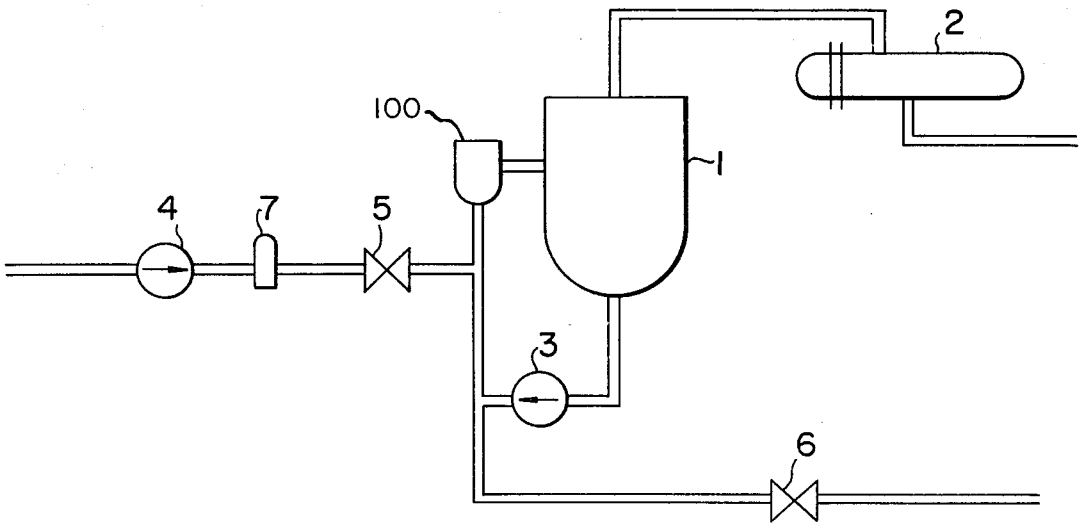
FIG. 1C PRIOR ART
Figure 2:
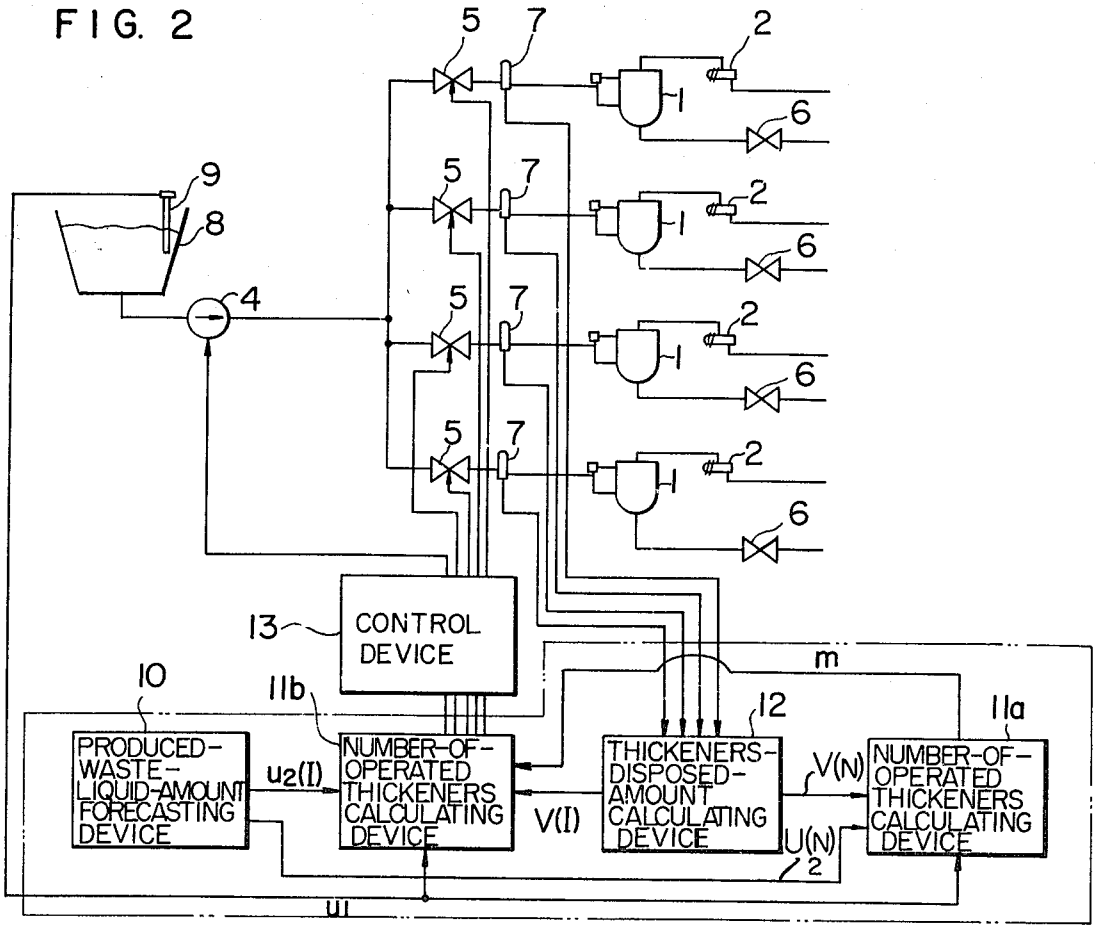
FIG. 2 is a block diagram showing a configuration of an embodiment of the present invention.

In FIG. 2 showing an embodiment of the present invention, numerals 1 to 7 show means similar to those denoted by like numerals in FIG. 1C. Numeral 8 shows a storage tank, numeral 9 a water level gauge, numeral 10 a produced waste-liquid-amount forecasting device, **11*a* and 11*b* number-of-operated-thickeners calculating devices, numeral 12 a thickeners-disposed-amount calculating device and numeral 13** a control device.

The produced-waste-liquid-amount calculating device 10 is for forecasting and calculating, for each hour on the past data, the amount of waste liquid produced from the power-generating units for N hours from the present. In this case, the forecast amount of waste liquid at the time I is expressed as $U_2(I)$.

The thickeners-disposed-amount calculating device 12, in response to the signal from the integrating flow meter 7, calculates over N hours at regular intervals of time, the amount of waste liquid V(I) disposed of before time point I by the thickeners operating at present.

The first number-of-operated-thickeners calculating device **11*a* is for calculating the maximum value m (number of disposal units to be started anew) satisfying the inequality (2) when I equals N, on the basis of the present amount of waste liquid $U_1$ calculated in response to the signal from the water level gauge 9, the data indicating $U_2(N)$ applied from the produced waste-liquid-amount forecasting device 10, and the data representing V(N) obtained from the thickeners-disposed-amount calculating device 12**.

The second number-of-operated-thickeners calculating device **11*b* is for deciding by calculation, in response to the signals $U_1$, $U_2(I)$, V(I) and the data representing m, whether or not the value m calculated by the device 11*a*** satisfies inequality (1). If the value m satisfies inequality (1), it indicates that even if additional m waste liquid disposal units are started, no stand-by, no-load operation of the thickeners occur until N hours later.

The signal representing the value m is applied to the control device 13, so that the valves 5 in the number of m are newly opened in response to that signal m. Thus thickeners are started while at the same time increasing the output of the pump 4 accordingly.

If the value m satisifies inequality (2) but not inequality (1), 1 is subtracted from m thereby to obtain the value that satisfies inequality (1).

In the above-mentioned configuration, the devices 10, 11*a*, 11*b* and 12 are all for performing the predetermined calculations on the basis of the past data or detected signals. Therefore, the operations of these devices surrounded by the dashed line may be performed alternatively by a single digital computer. The description below, however, will be made with reference to the case in which the devices 10 to 12 are comprised of separate hardware for convenience' sake.

Figure 3:
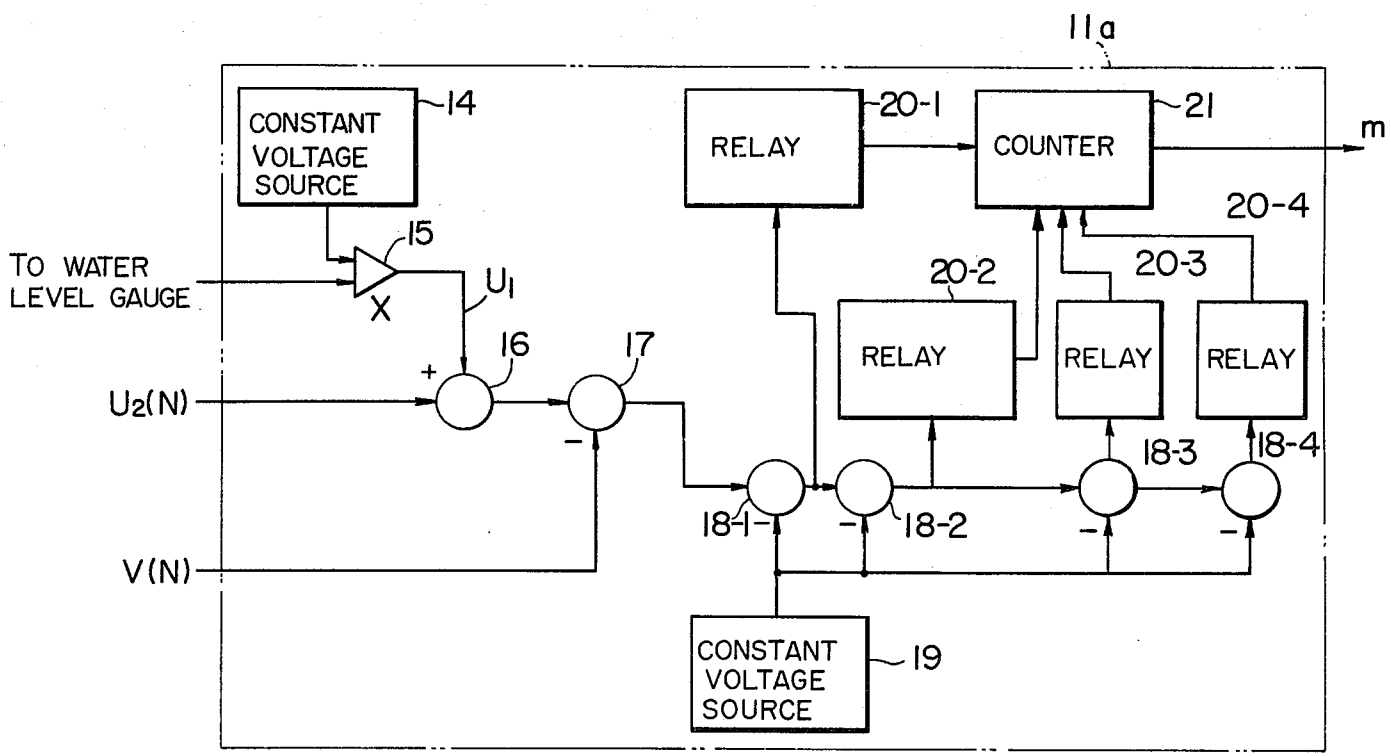
FIG. 3 is a block diagram showing a specific example of the first number-of-operated-thickeners calculating device **11*a***.

A specific example of the first number-of-operated-thickeners calculating device 11*a* is shown in FIG. 3. Numeral 14 shows a constant voltage source, numeral 15 a multiplier, 16 an adder, 17 and 18-1, 18-2, 18-3 and 18-4 subtractors, 19 a constant voltage source, 20-1, 20-2, 20-3 and 20-4 relays and 21 a counter.

The constant voltage source 14 stores the value of the bottom area of the storage tank. The multiplier 15 is for multiplying the reading of the water level gauge 9 by the value stored in the constant voltage source 14, thereby calculating the amount of waste liquid $U_1$ in the storage tank. The adder 16 adds the result of calculation by the multiplier 15 to the value $U_2(I)$ supplied from the produced-waste-liquid-amount forecasting device 10 at the time of $I=N$, i.e., the forecast value $U_2(I)$ at the time N hours later, thus calculating the amount of waste liquid $U_1+U_2(N)$ received by the storage tank 8 before N hours later. The subtractor 17 is for subtracting from the sum produced by the adder 16 the amount V(N) processed by the presently-operated thickeners before N hours later which is supplied from the thickeners-disposed-amount calculating device 12, thus calculating the amount of waste liquid which remains undisposed at the time N hours later if the presently-operated thickeners continue to be operated. The constant voltage source 19 keeps in store the amount of waste liquid V' processed by one thickener from the starting thereof to the bumping. The subtractor 18-1 is for subtracting the value of the constant voltage source 19 from the calculated result of the subtractor 17. The relay 20-1 produces a pulse when the calculated result of the subtractor 18-1, i.e., the value $U_1+U_2(N)-V(N)-V'$ is positive. The substractor 18-2 is one for subtracting the value of the constant voltage source 19 from the calculated result of the subtractor 18-1. The relay 20-2 produces a pulse when the calculated result of the subtractor 18-2, i.e. the value $$[U_1+U_2(N)-V(N)-V'(N)]-V'(N)=U_1+U_2(N)-V(N)-2V'(N)$$

is positive. This is the same also for the relays 20-3 and 20-4. The counter 21 is for adding the total pulses of the relays 20-1, 20-2, 20-3 and 20-4 and producing the result thereof.

In other words, the counter 21 produces the value of maximum m that satisfies the relation $U_1+U_2(N)\geqq V(N)+mV'$(m: positive integer), which is identical to the value m satisfying the inequality (2) above.

Figure 4:
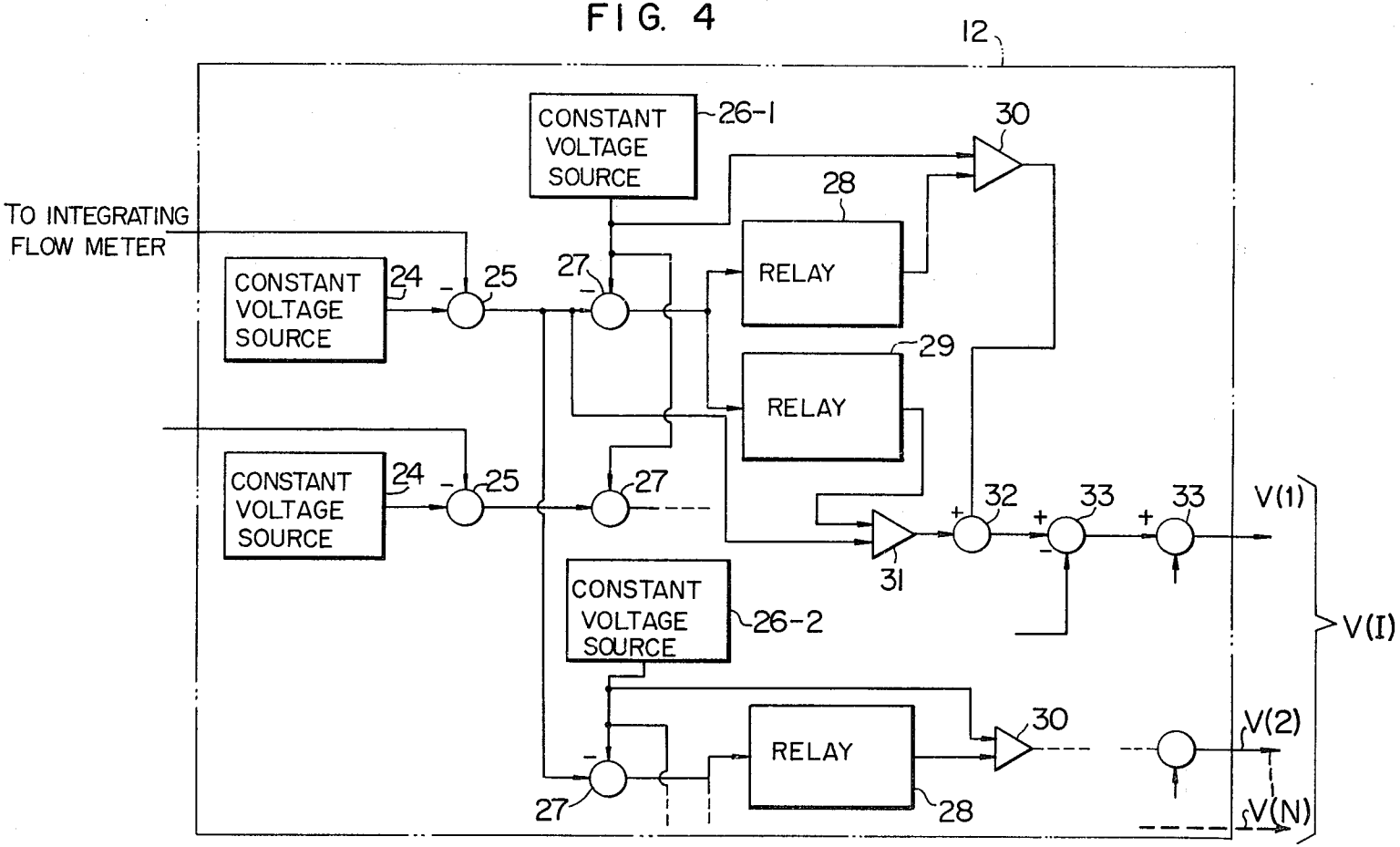
FIG. 4 is a block diagram showing a specific example of the thickeners-disposed-amount calculating device 12.

A specific example of the configuration of the thickeners-disposed-amount calculating device 12 is shown in FIG. 4. Numeral 24 shows a constant voltage source, 25 a subtractor, 26 a constant voltage source, 27 a subtractor, 28 and 29 relays, 30 and 31 multipliers, and 32 and 33 adders. The constant voltage source 24 stores the amount of waste liquid processed by one thickener for the period from starting to bumping. The subtractor 25 is for subtracting the indication of the integrating flow meter 7 representing the integrated calculation of the amount of waste liquid processed up to the present from the value produced by the constant voltage source 24, thus calculating the amount of waste liquid capable of being processed by the corresponding thickener 1 from the present time point to the bumping. The constant voltage sources 26 are impressed with the amount of waste liquid processed by the operation of one thickener for a predetermined period of time without bumping. For instance, the constant voltage source 26-1 is supplied with the amount of waste liquid processed for one hour by the thickener, and the constant voltage source 26-2 with the amount of waste liquid processed for two hours. Description will be made below with reference to the case where the predetermined time is I. The subtractor 27 subtracts the value of the constant voltage source 26 from the calculated result of the subtractor 25. The relay 28 is for producing signal "1" when the calculated result of the subtractor 27 is positive, i.e., when the corresponding thickener fails to bump for the period of one hour from the present time to the time point I. The relay 28 outputs a signal of "0" when the calculation result of the subtractor 27 is negative. The multiplier 30 is for multiplying the value produced from the constant voltage source 26 by the value produced from the relay 28. The result of calculation is equal to that of the constant voltage source 26-1 when the output of the relay 28 is "1", while it is 0 when the output of the relay 28 is "0". The relay 29 produces a signal "1" when the output of the subtractor 27 is negative, i.e., when the corresponding thickener dumps before the time I. The relay 29 outputs a signal of "0" when the calculation result of the subtractor 27 is negative. The multiplier 31 multiplies the calculated value of the subtractor 25-1 by that of the relay 29. The calculated results represent the amount $V_1$ of waste liquid processed by the thickener before the bumping (before the time I) when the output of the relay 29 is "1", while it represents 0 when the output of the relay 29 is "0". Either one of the calculation results of multipliers 30 and 31 is usually "0". On occassion of the bump, the output of the multiplier 30 is "0" and in the case of no bump, the output of the multiplier 31 is "0". The adder 32 is for adding the calculated results of the multipliers 30 and 31 thereby to determine the amount of waste liquid processed by the corresponding thickener before the time point I. The adder 33 is for adding the amounts of waste liquid processed by the presently-operated respective thickeners from the present time point to the time point I, thus producing the total amount V(I) of waste liquid processed by all the presently-operated thickeners up to the time point I, it being understood that V(I) represents the amounts V(I), V(2) . . . V(N).

Figure 5:
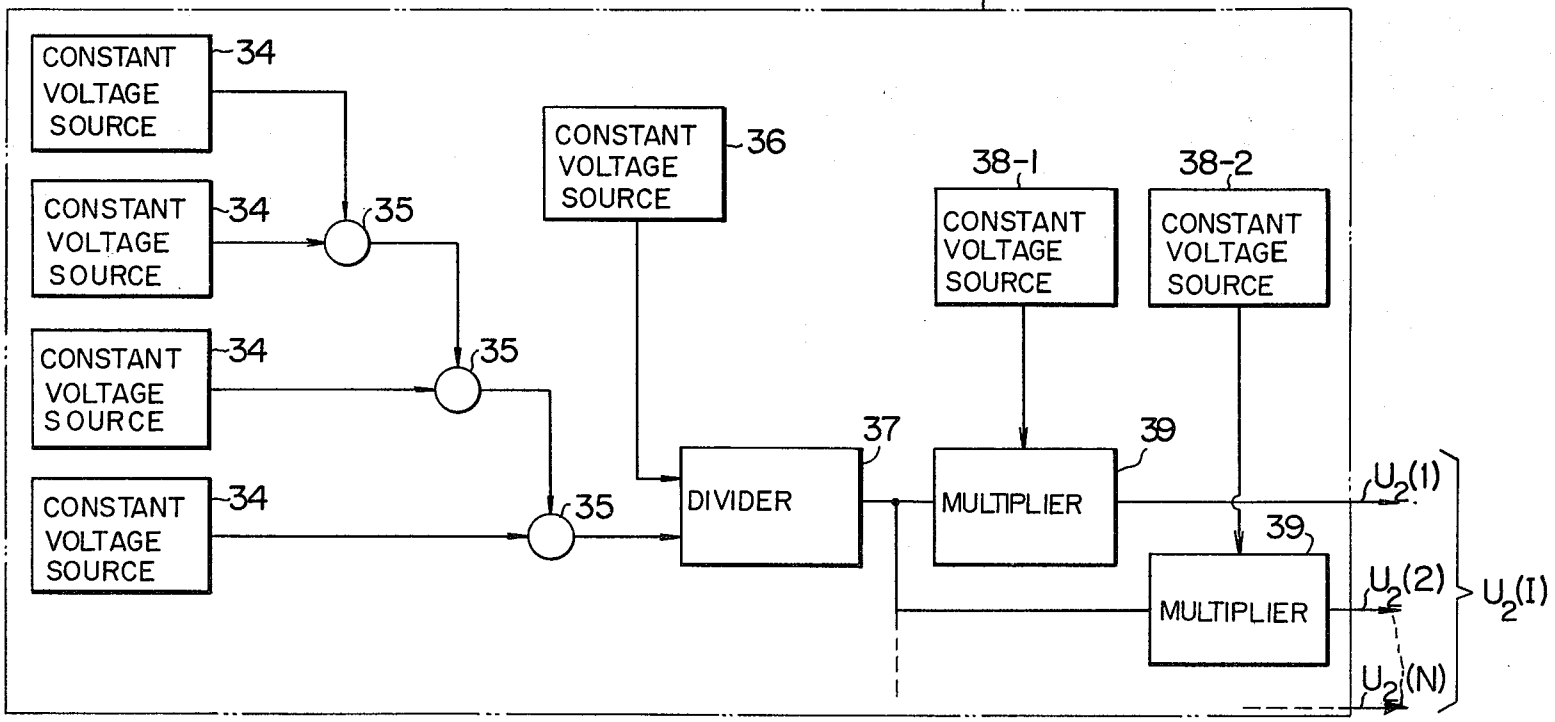
FIG. 5 is a block diagram showing a specific example of the produced-waste-liquid-amount forecasting device.

A specific example of the produced-waste-liquid-amount forecasting device 10 is shown in FIG. 5. Numeral 34 shows constant voltage sources, 35 adders, 36 another constant voltage source, 37 a divider, 38 constant voltage sources, and 39 multipliers. Each of the constant voltage sources 34 keeps in store the amount of waste liquid produced for each of past several days (four days in this case). The adders 35 add these amounts of waste liquid thereby to calculate the total amount of the waste liquid produced for the four days. The constant voltage source 36 stores the value of $1/(4\times24)$. The divider 37 is for multiplying the calculated result of the adders 35 by the value stored in the constant voltage source 36, thus forecasting the amount of waste liquid produced for one hour. The constant voltage source 38 stores the value of a predetermined period of time (1 in 38-1 and 2 in 38-2). The multiplier 39 is one for multiplying the forecast amount of waste liquid produced for one hour by the predetermined period of time, thus calculating the forecast value $U_2(I)$ of waste liquid produced before the given time point I, $U_2(I)$ thereby representing the amounts $U_2(1)$, $U_2(2)$ . . . $U_2(N)$.

Figure 6:
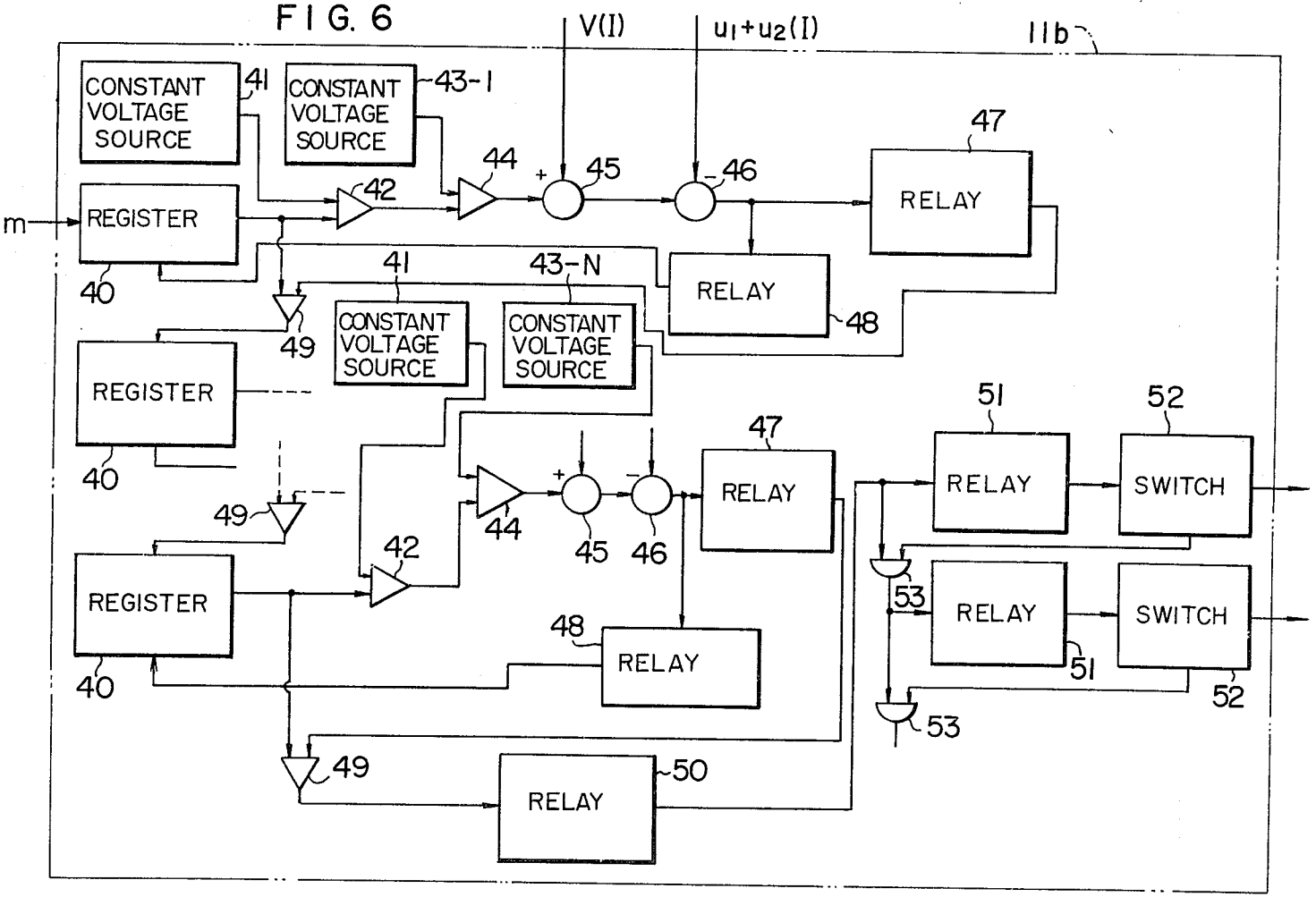
FIG. 6 is a block diagram showing a specific example of the second number-of-operated-thickeners calculating device **11*b***.

An example of a specific configuration of the second number-of-operated disposal-units calculating device **11*b* is illustrated in FIG. 6. Numeral 40 shows a register, 41 a constant voltage source, 42 a multiplier, 43 a constant voltage source, 44 a multiplier, 45 an adder, 46 a subtractor, 47 and 48 relays, 49 a multiplier, 50 and 51 relays, 52 switches, and 53 and AND relay. The register 40 memorizes the number of thickeners (m) to be newly started, which is notified from the first number-of-operated-thickeners calculating device 11*a*. The constant voltage source 41 stores the amount of waste liquid processed by a thickener per unit time. The multiplier 42 is one for multiplying the value of the register 40 by the value of the constant voltage source 41, thus calculating the amount of waste liquid processed by m thickeners per unit time. The constant voltage source 43 stores the value I if the amount processed before time point I is to be calculated. (If the amount of waste liquid processed during N hours is calculated hour by hour, for instance, the 43-1 stores the value 1 and the 43-N the value N.) The multiplier 44 multiplies the calculated value of the multiplier 43 by the value in the constant voltage source 43, thus calculating the amount of waste liquid processed by m thickeners up to the time point I. The adder 45 is for adding the amount of waste liquid V(I) (notified by the thickeners-disposed-amount calculating device 12) processed by the presently-operated thickeners up to the time point I to the calculated value $mV'(I)$ of the multiplier 44, thus calculating the total amount of waste liquid $mV'(I)+V(I)$ processed by the newly-started thickeners and the already-started thickeners up to the time point I. The subtractor 46 subtracts from the value of the adder 45 the amount of waste liquid $U_1$ existing in the storage tank at present and the amount of waste liquid $U_2(I)$ produced from the present time up to the time point I. When this value is positive, the processsing capacity of the thickeners exceeds the amount of waste liquid produced, thus resulting in stand-by, no-load operation. When the calculated result of the subtractor 46 is positive, the relay 48 applies the value $-1$ to the register 40. In this way, the newly-started thickeners are reduced by one. When the result of calculation at the subtractor 46 is negative, on the other hand, the relay 47 produces a signal "1". The multiplier 49 multiplies the value of the register 40 by the output of the relay 47, and applies the product to the next register 40. The relay 50 is for producing m pulses at regular intervals of time ($t_0$, for instance) when the input from the multiplier 49 is m. The relay 51 is for producing the applied pulse after delaying it for a predetermined time t ($t<<t_0$). The switch 52 is turned on in response to a pulse from the relay 51, thereby starting a thickener corresponding to the switch 52. When a pulse is applied from the relay 51 with the switch 52 turned on, the switch 52 remains turned on. The switch 52, immediately after being turned on, applies signals "1" continuously to the AND gate 53. The AND gate 53 produces a pulse "1" if it receives a pulse from the relay 50 while being supplied with the signal "1" from the switch 52. Thus, in the case where m thickeners are required to be started newly, for instance, signals "1" are produced at m output terminals and signals "0" at the other output terminals. These output signals are applied to the control device 13 and start the thickeners corresponding to the outputs "1", with the result that the valves 5 corresponding to the particular thickeners are opened. Also, the output of the pump 4** is of course increased at the same time.

Although the above-mentioned embodiment is concerned with the forecasting of the average daily amount of waste liquid produced for the past several days, the present invention may be alternatively configured to forecast the production of waste liquid by use of the distribution of waste liquid production and random number generator. Further, the time length N, which is a range capable of being forecast for production of waste liquid, may alternatively be an appropriate value such as one or two days, or a variable length of time such as the time before the earliest-occurring dumping of the thickeners.

As explained above, according to the present invention, (1) The stand-by, no-load operation of the thickeners is eliminated. As a result, the operating labor is saved on the one hand and the operating cost is reduced on the other hand. Further, the too early bumping without any stand-by, no-load operation which imposes a burden on the post-processes is eliminated.

(2) In view of the fact that the required minimum number of thickeners are operated, the frequency of bumping in the course of processing a great amount of waste liquid produced is reduced.

What we claim is:

1. A system for controlling the number of waste liquid disposal units in operation, comprising a plurality of the waste liquid disposal units, first means for temporarily storing the waste liquid to be supplied to said waste liquid disposal units, second means for supplying said waste liquid from said waste liquid storage means to said waste liquid disposal units, third means for measuring the amount of waste liquid $U_1$ stored in said storage means at the present time, fourth means for forecasting the amount of waste liquid $U_2(I)$ flowing into said storage means for the period of time from the present time to each of a plurality of given time points I wherein $I\leqq N$ where N is a predetermined maximum period of time, fifth means for calculating the amount of waste liquid V(I) capable of being disposed of by the presently-operated waste liquid disposal units for the period of time from the present time to each of the given time points I, sixth means for calculating the maximum number m of the disposal units which simultaneously satisfies the following inequality for all of the points I satisfying the relation $0<I<N$, $$U_1+U_2(I)\geqq V(I)+mV'(I)$$

where V'(I) is the amount of waste liquid processed by each one of said waste liquid disposal units for the period of time from the present time to each of the given time points I, and seventh means for controlling the operation of said plurality of said waste liquid disposal units according to the output of said sixth means.

2. A system for controlling the number of waste liquid disposal units according to claim 1, in which said seventh means controls the valves and pumps in said second means in accordance with the value m calculated by said sixth means.

3. A system for controlling the number of waste liquid disposal units according to claim 1, in which said fifth means calculates the amount of waste liquid V(I) capable of being disposed of by the presently-operated disposal units for the period up to the time point I, in response to the output signal of an integrating flow meter mounted in said second means.

* * * * *